US009345950B2

(12) United States Patent
MacDonald et al.

(10) Patent No.: US 9,345,950 B2
(45) Date of Patent: May 24, 2016

(54) BACCARAT GAME WITH SIDE WAGERS

(71) Applicant: Las Vegas Sands Corp., Las Vegas, NV (US)

(72) Inventors: Andrew MacDonald, Singapore (SG); Kelvin Morin, Las Vegas, NV (US)

(73) Assignee: Las Vegas Sands Corp., Las Vegas, NV (US)

( * ) Notice: Subject to any disclaimer, the term of this patent is extended or adjusted under 35 U.S.C. 154(b) by 0 days.

(21) Appl. No.: 14/210,173

(22) Filed: Mar. 13, 2014

(65) Prior Publication Data

US 2014/0265129 A1 Sep. 18, 2014

Related U.S. Application Data

(60) Provisional application No. 61/780,928, filed on Mar. 13, 2013.

(51) Int. Cl.

| | |
|---|---|
| ***A63F 1/00*** | (2006.01) |
| ***A63F 1/02*** | (2006.01) |
| *A63F 1/04* | (2006.01) |

(52) U.S. Cl.

CPC ... *A63F 1/02* (2013.01); *A63F 1/04* (2013.01); *A63F 2001/001* (2013.01); *A63F 2001/0475* (2013.01)

(58) Field of Classification Search

CPC ..... A63F 2001/001; A63F 1/00; A63F 1/04; A63F 2001/0475

USPC ..... 273/303, 304, 302, 308, 292; 463/11–13

See application file for complete search history.

(56) References Cited

U.S. PATENT DOCUMENTS

| | | | | |
|---|---|---|---|---|
| 5,718,432 | A | 2/1998 | Fraser | |
| 2004/0023706 | A1 * | 2/2004 | Hunter et al. | 463/13 |
| 2007/0063443 | A1 | 3/2007 | Moshal | |
| 2009/0189350 | A1 * | 7/2009 | Chang | 273/304 |
| 2011/0057391 | A1 * | 3/2011 | Wong et al. | 273/292 |
| 2011/0260402 | A1 | 10/2011 | Crumsey | |
| 2013/0324232 | A1 * | 12/2013 | Snow | 463/26 |

* cited by examiner

*Primary Examiner* — Benjamin Layno

(74) *Attorney, Agent, or Firm* — McDermott Will & Emery LLP

(57) ABSTRACT

A new deck of cards and a method of facilitating a card game with said new deck of cards are provided. The method including receiving a set of wagers from a player on an outcome of a card game played using a deck of cards, the deck of cards including five groups of cards, each group of card represented by a unique suit and thirteen cards within each group of cards, the thirteen cards each having a unique rank, wherein the unique ranks include one of ace or one, the numbers two through ten, and three face cards, dealing the cards of the deck of cards according to one or more rules characterizing the card game and providing a return based on the outcome of the card game with respect to the set of wagers.

8 Claims, 6 Drawing Sheets

500 501 502

| Traditional | House Advantages | Modified | House Advantages |
|---|---|---|---|
| **Player Bet** | | **Player Bet** | |
| 6 Decks | 1.237415% | 6 Decks | 1.235547% |
| | | 7 Decks | 1.234483% |
| 8 Decks | 1.235081% | 8 Decks | 1.233686% |
| 6 Deck (7-Up) | 2.604878% | 6 Deck (7-Up) | 2.595055% |
| | | 7 Deck (7-Up) | 2.589462% |
| | | 8 Deck (7-Up) | 2.585277% |
| | | 6 Deck (Power) | 1.100049% |
| | | 7 Deck (Power) | 1.099001% |
| 8 Deck (Power) | 1.099590% | 8 Deck (Power) | 1.098217% |
| | | | |
| | | | |
| **Tie Bet** | | **Tie Bet** | |
| 6 Decks | 14.43816% | 6 Decks | 14.375430% |
| | | 7 Decks | 14.339244% |
| 8 Decks | 14.359963% | 8 Decks | 14.311943% |
| 6 Deck (7-Up) | 4.05026% | 6 Deck (7-Up) | 4.084361% |
| | | 7 Deck (7-Up) | 4.103866% |
| | | 8 Deck (7-Up) | 4.118503% |
| | | 6 Deck (Power) | 13.641841% |
| | | 7 Deck (Power) | 13.605313% |
| 8 Deck (Power) | 13.6259% | 8 Deck (Power) | 13.577755% |
| | | | |
| **Natural 8's** | | **Natural 8's** | |
| | | 6 Deck (Power) | 29.736662% |
| | | 7 Deck (Power) | 29.723830% |
| 8 Deck (Power) | 29.731043% | 8 Deck (Power) | 29.714232% |
| | | | |
| **Natural 9's** | | **Natural 9's** | |
| | | 6 Deck (Power) | 21.215467% |
| | | 7 Deck (Power) | 21.246292% |
| 8 Deck (Power) | 21.228952% | 8 Deck (Power) | 21.269413% |
| | | | |
| **Banker Bet** | | **Banker Bet** | |
| 6 Decks | 1.055849% | 6 Decks | 1.057495% |
| | | 7 Decks | 1.058433% |
| 8 Decks | 1.057906% | 8 Decks | 1.059134% |
| 6 Decks (NC) | 1.454808% | 6 Decks (NC) | 1.457446% |
| | | 7 Decks (NC) | 1.458950% |
| 8 Decks (NC) | 1.458104% | 8 Decks (NC) | 1.460075% |
| 6 Deck (7-Up) | 2.559161% | 6 Deck (7-Up) | 2.575302% |
| | | 7 Deck (7-Up) | 2.584503% |
| | | 8 Deck (7-Up) | 2.591393% |
| | | 6 Deck (Power) | 0.921997% |
| | | 7 Deck (Power) | 0.922951% |
| 8 Deck (Power) | 0.922415% | 8 Deck (Power) | 0.923664% |
| | | | |
| **Pair Bet** | | **Pair Bet** | |
| 6 Decks | 11.254019% | 6 Decks | 10.53985% |
| | | 7 Decks | 10.13216% |
| 8 Decks | 10.361446% | 8 Decks | 9.82659% |
| | | 6 Deck (Power) | 9.77523% |
| | | 7 Deck (Power) | 9.36406% |
| 8 Deck (Power) | 9.595304% | 8 Deck (Power) | 9.05588% |
| | | | |
| | | | |
| **Super 7's** | | **Super 7's** | |
| 6 Deck (7-Up) | 8.861613% | 6 Deck (7-Up) | 8.783194% |
| | | 7 Deck (7-Up) | 8.737801% |
| | | 8 Deck (7-Up) | 8.703476% |

FIG. 5

BACCARAT GAME WITH SIDE WAGERS

CROSS-REFERENCE TO RELATED APPLICATION

The present application claims the benefit of U.S. Provisional Patent Application Ser. No. 61/780,928, entitled "BACCARAT GAME WITH SIDE WAGERS," filed on Mar. 13, 2013, which is hereby incorporated by reference in its entirety for all purposes.

BACKGROUND

A card game is a game played using playing cards as the primary device. A variety of card games (e.g., baccarat, black jack, families of related games (such as poker), etc.), allow for wagering. Such games may be played and wagered upon in a casino. Traditionally, these games are played with a standard deck of fifty-two cards comprising four suits (hearts, clubs, spades, and diamonds) and thirteen ranks (Ace, 2, 3, 4, 5, 6, 7, 8, 9, 10, Jack, Queen, and King).

SUMMARY

The disclosed subject matter relates to a deck of cards for playing a card game, the deck of cards comprising five groups of cards, each group of card represented by a unique suit and thirteen cards within each group of cards, the thirteen cards each having a unique rank, wherein the unique ranks include one of an ace or one, the numbers two through ten, and three face cards.

The disclosed subject matter also relates to a method for facilitating a card game using a modified deck of cards, the method comprising receiving a set of wagers from a player on an outcome of a card game played using a deck of cards, the deck of cards comprising five groups of cards, each group of card represented by a unique suit and thirteen cards within each group of cards, the thirteen cards each having a unique rank, wherein the unique ranks include one of ace or one, the numbers two through ten, and three face cards. The method further comprising dealing the cards of the deck of cards according to one or more rules characterizing the card game and providing a return based on the outcome of the card game with respect to the set of wagers.

The disclosed subject matter also relates to a system for facilitating a card game using a modified deck of cards, the system comprising one or more processors and a machine-readable medium comprising instructions stored therein, which when executed by the processors, cause the processors to perform operations comprising receiving a set of wagers selectable from a plurality of wagers from a player on an outcome of a card game played using a deck of cards. The deck of cards may comprise five groups of cards, each group of card represented by a unique themed suit and thirteen cards within each group of cards, the thirteen cards each having a unique rank, wherein the unique ranks include one of ace or one, the numbers two through ten, and three face cards, the face cards comprising the Chinese gods Fuk, Luk and Sau. The operations may further comprise dealing the cards of the deck of cards according to one or more rules characterizing the card game and providing a return based on the outcome of the card game with respect to the set of wagers, wherein the plurality of wagers include at least one wager according to the unique relationship between the themed suits and at least one wager according to the ranks of the face cards.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

Certain features of the subject technology are set forth in the appended claims. However, for purpose of explanation, several embodiments of the subject technology are set forth in the following figures.

FIG. 5 illustrates an example table providing a side by side comparison of the odds of different variations of the game of baccarat played using a standard deck and a new deck of cards.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

The subject disclosure provides for a modified deck of cards ("new deck") that can be used for playing traditional card games, including for example, baccarat, while allowing for additional wagers (e.g., side wagers). In one example, the traditional game may be played with same or similar odds using the new deck (e.g., a single set or multiple sets of the new deck). In some examples, the new deck may provide same or similar odds as combining multiple decks of standard 52-card deck ("standard deck") of cards.

The new deck may include five suits, with each suit having thirteen ranks. In one example, the new deck differs from a standard deck in that it includes an additional suit of thirteen ranks. Thus, the number of cards in the new deck is 65 cards.

In one example, the new deck of cards may include five themed suits. Each suit may be represented using a symbol in some embodiments. In one example, the symbols for each suit may include one or more of a unique shape, characters and/or color. For example, in one implementation, the suits may consist of the "Wu Xing" ("five elements") in traditional Chinese philosophy. The five elements may include metal, wood, water, fire, and earth. Each of the five elements of traditional Chinese philosophy may be illustrated as shown in FIG. 1.

Figure 1:
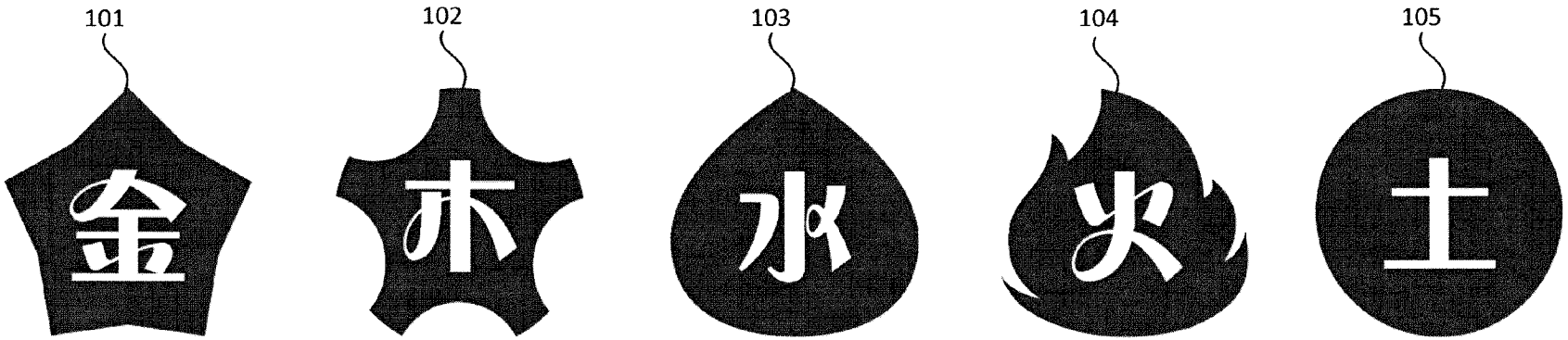
FIG. 1 includes exemplary symbols representing the themed suits of a new deck of cards.

FIG. 1 includes symbols 101, 102, 103, 104, and 105. Symbol 101 represents the element metal, symbol 102 represents the element wood, symbol 103 represents the element water, symbol 104 represents the element fire, and symbol 105 represents the element earth. Each symbol 101-105 is represented as a unique shape and includes unique characters identifying the suit. In some examples, each symbol may further include unique colors differentiating the suit.

While any set of themed suits may be used with respect to the new deck, one or more themed suits may provide a relationship that may be used as a basis for additional wagers. For example, the five elements have certain significance in many aspects of Chinese culture, such as traditional medicine, martial arts, music, and a form of geomancy known as Feng shui. In such arts and philosophies, the elements may be considered to be part of an ordered cycle.

Figure 2:
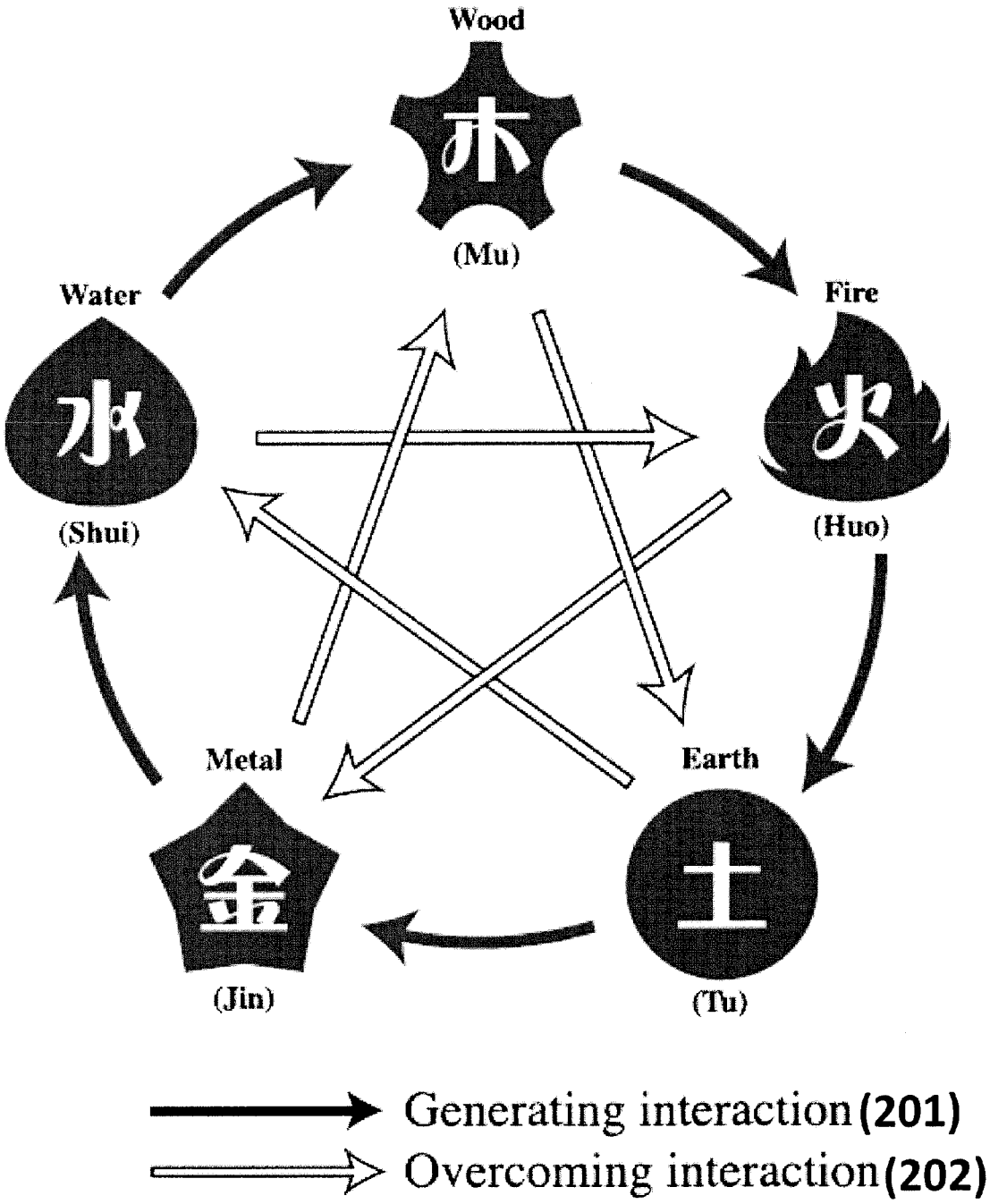
FIG. 2 illustrates the cycle relationship of the elements used as the themed suits in one example of a new deck of cards.

FIG. 2 illustrates the cycle relationship of the elements used as the themed suits in one example of the new deck of cards. As shown in FIG. 2, the elements, each represented as one of the five suits in one example of the new deck, may include a generating interaction 201 and an overcoming interaction 202 with one another. In some example, one or both the generating interaction 201 or the overcoming interaction 202 or a combination of the interactions 201 and 202 may serve as a basis for side wagers, for example, in a game (e.g., baccarat) played with the new deck as described herein.

As described above, each suit includes thirteen ranks. In one example, the ranks may be similar to a standard deck of cards. In another example, the thirteen ranks in the new deck of cards may include the standard ace (or one) through ten (10) cards. The face cards of the standard deck may be replaced, in one example, with different values from the standard deck of cards. For example, the face cards may be replaced with ranks representing Chinese gods "Fuk" (or "Fu"), the god of blessings or good fortune, "Luk" (or "Lu"), the god of prosperity, and Sau (or "Shou"), the god of longevity. In one example, the gods Fuk, Luk and Sau may replace King, Queen and Jack respectively.

Figure 3B:
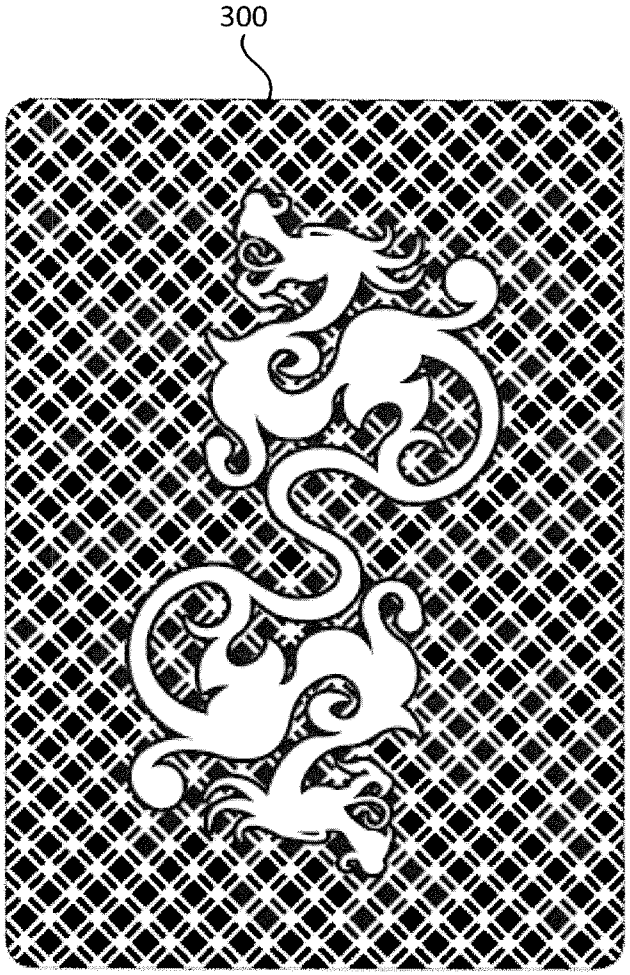
FIG. 3B illustrates the backside of an example card of the new deck of cards.
Figure 3A:
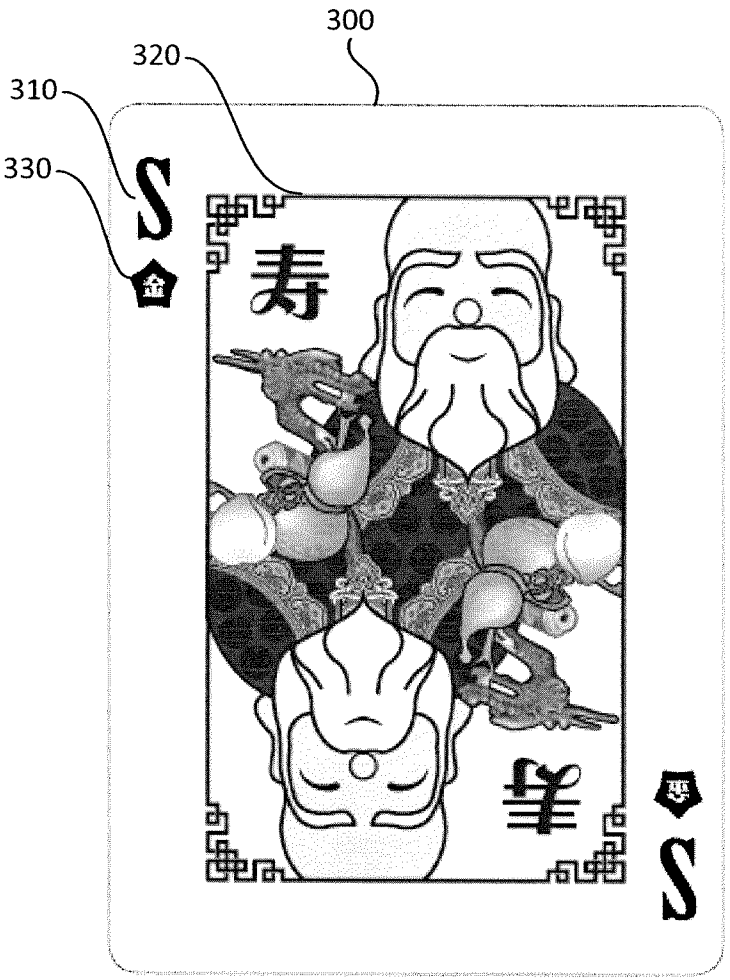
FIG. 3A illustrates an example face of card of a new deck of cards.
Figure 4:
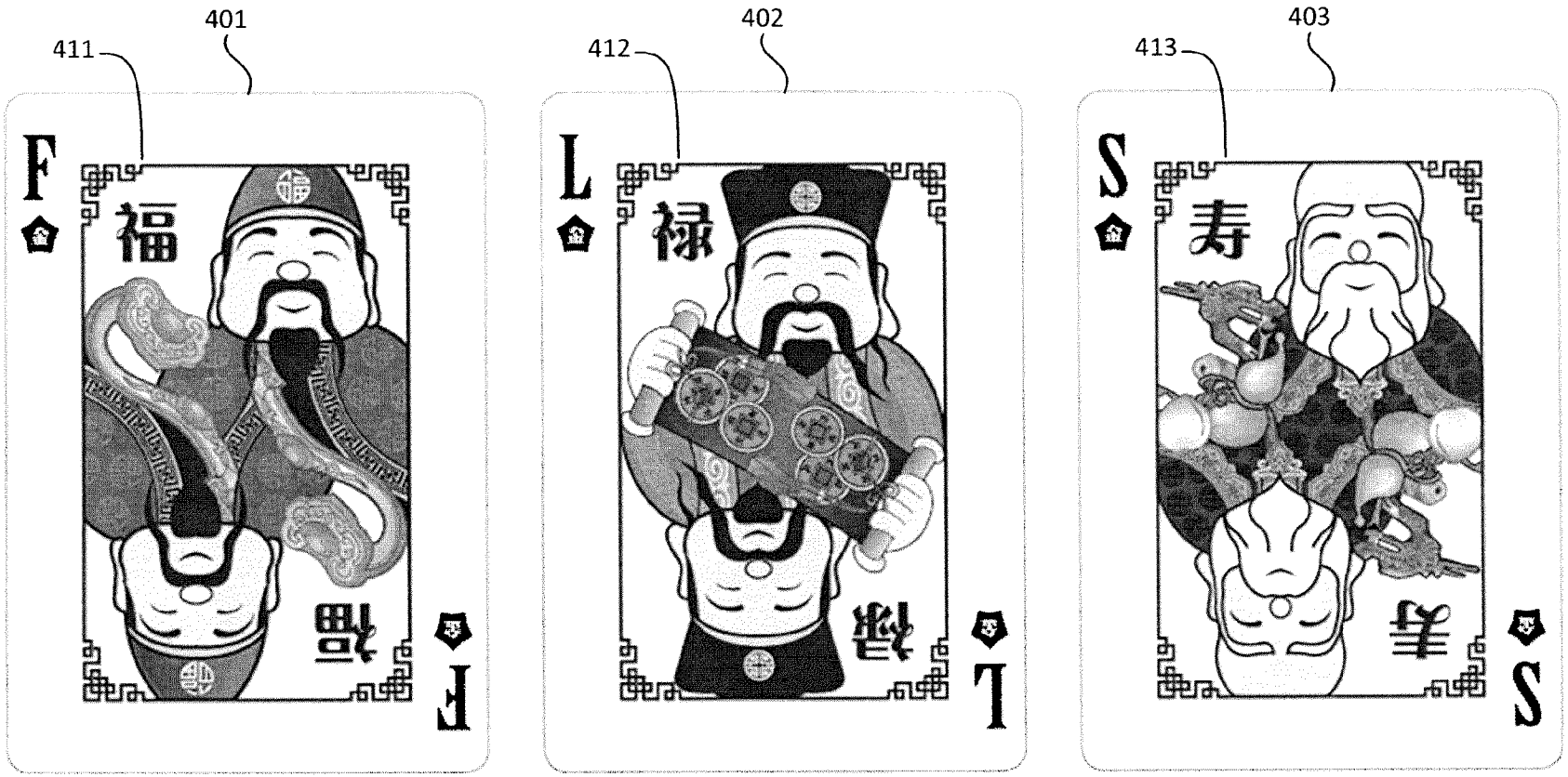
FIG. 4 illustrates an example set of face cards for use with a new deck of cards.

FIG. 3A illustrates an example face of card 300 of the new deck. The face of example card 300 includes a rank identifier 310 displayed at the top and bottom of the card, a graphical representation of the rank 320, and a suit symbol 330 displayed at the top and bottom of the card, representing the suit metal for example purposes. The rank representation for each card of the new deck may for example include a number of suit symbols equal to the rank for one or more of the ranks including ace through ten (10). In some examples, the ace may be represented as a one or an ace, and/or may include a unique graphical representation. In some examples, the graphical representation for each of the ace through ten (10) ranks of each suit may be similar to a standard deck of cards. In one example, as illustrated in FIG. 4, described in more detail below, in one example each of the face cards represent a god (e.g., Fuk, Luk and Sau). FIG. 3B illustrates the backside of card 300. The backside of card 300 may include a graphical symbol or other indicia.

FIG. 4 illustrates an example set of face cards for use with the new deck. The face cards 401, 402 and 403 of a single suit of the five suits of the deck are illustrated herein for example purposes. For example, in FIG. 4, face card 401 includes a graphical representation 411 associated with the god Fuk. Face card 402 includes a graphical representation 412 associated with the god Luk, and the face card 403 includes a graphical representation 413 of the god Sau. The face card 403 is similar to the card 300 displayed in FIG. 3. In one example, as described above, each of the face cards 401, 402 and 403 may replace the ranks King, Queen, Jack, and of the ranks of the standard 52 card deck.

In one example, maintaining the standard number of ranks of cards allows for providing same or similar odds or advantages (e.g., odds within a margin that is not significant and/or noticeably impacted) for playing card games. In some examples, various card games may be played using the new deck (e.g., using a single set or multiple sets of the new deck) without changing the rules of the card games. In some examples, for games played using the new deck, the odds of the game may be impacted in the same degree that would result from an increase in the number of decks. The additional thirteen cards of the additional suit may allow for side wagers in these card games. In some examples, the same or similar odds are provided for card games that are suit independent where suits have no relevance in determining the outcome of the game. In such games, adding (or removing) one or more suits would not change the odds of playing the game (e.g., the odds between the player and the house). For example, mathematically, the effect of adding an additional suit is the same as increasing the number of standard decks.

In one example, the card game is played by one or more players. A set of wagers on an outcome of a card game played using the new deck or multiple sets of the new deck (e.g., including one or more base bets and/or side wagers) are received from the one or more players. The new deck (e.g., single set or multiple sets) is dealt and/or the card game is played according to the rules of the card game (e.g., rules of one or more traditional card games). A return is then provided based on the outcome of the card game with respect to the set of wagers.

In one example, the new deck may be used to play the card game baccarat. The traditional baccarat game is suit-independent. Thus, in some implementations, suits have no relevance in determining the outcome of the game. As such, the odds of playing the game (e.g., the odds between the player and the house) are the same as the odds that result from increasing the number of standard decks.

FIG. 5 illustrates an example table 500 providing a side by side comparison of the house advantage, or the expected win percentage of the house, in different variations of the game of baccarat played using a standard deck and the new deck. Table 500 includes a first column 501 illustrating the house advantage for the games of baccarat played with a standard deck of cards (e.g., a 52 card deck of 4 suits and 13 ranks per suit), and a second column 502 illustrating corresponding house advantage for the games played with the new deck of cards. The house advantage for the game variations in columns 501 and 502 of table 500 are represented by the house advantage. The house advantage is provided for multiple example variations of the game of baccarat represented by bets/deck variations.

Variations of the baccarat game displayed within column 501 include the base game variations player bet/6 decks, player bet/8 decks, player bet/6 decks 7-up and player bet/8 decks power, banker bet/6 decks, banker bet/8 decks, banker bet/6 decks 7-up, banker bet/8 decks power, banker bet/6 decks no commission ("NC") and banker bet/8 decks NC, as well as optional side wager variations tie bet/6 decks, tie bet/8 decks, tie bet/6 decks 7-up and tie bet/8 decks power, pair bet/6 decks, pair bet/8 decks and pair bet/8 decks power, Natural 8's bet/8 decks power, Natural 9's bet/8 decks power, and Super 7's bet/6 decks 7-up.

Variations of the baccarat game displayed within column 502 include the base game variations player bet/6 decks, player bet/7 decks, player bet/8 decks, player bet/6 decks 7-up, player bet/7 decks 7-up, player bet/8 decks 7-up, player bet/6 decks power, player bet/7 decks power and player bet/8 decks power, banker bet/6 decks, banker bet/7 decks, banker bet/8 decks, banker bet/6 decks no commission ("NC'), banker bet/7 decks NC, banker bet/8 decks NC, banker bet/6 decks 7-up, banker bet/7 decks 7-up, banker bet/8 decks 7-up, banker bet/6 decks power, banker bet/7 decks power and banker bet/8 decks power, as well as optional side wager variations including tie bet/6 decks, tie bet/7 decks, tie bet/8 decks, tie bet/6 decks 7-up, tie bet/7 decks 7-up, tie bet/8 decks 7-up, tie bet/6 decks power, tie bet/7 decks power and tie bet/8 decks power, pair bet/6 decks, pair bet/7 decks, pair bet/8 decks, pair bet/6 decks power, pair bet/7 decks power, and pair bet/8 decks power, Natural 8's bet/6 decks power, Natural 8's bet/7 decks power and Natural 8's bet/8 decks power, Natural 9's bet/6 decks power, Natural 9's bet/7 decks power, Natural 9's bet/8 decks power, and Super 7's bet/6 decks 7-up, Super 7's bet/7 decks 7-up, Super 7's bet/7 decks 7-up. As illustrated, more variations are available using the new deck in comparison to the standard deck of cards.

A comparison of the house advantage in columns 501 and 502 of table 500 illustrates that in the base game for all variations (i.e., the actual game aside from the side wagers that may be placed on the game). The greatest positive impact is on the banker bet/6-deck 7-up variation, where the edge rises slightly by 0.0161%. The greatest negative impact is only −0.0098% on the player bet/6 deck 7-up variation. For optional side wagers, the greatest impacts are 0.04% and −0.7142% on the natural 8's bet/8 deck power variation and the pairs bet/6-deck variation respectively.

These changes in the house advantage, indicated in table 500, may be attributable to increasing the number of index values proportionally to the ratio of cards in each deck (1.25 to 1) and may be duplicated by similar increase in the number of decks with a standard deck (e.g., by the same or similar ratio). The modifications in the new deck and/or the changes in the face cards facilitates a unique array of proprietary side wagers, some of which are not possible with a standard four-suited deck of cards.

In certain embodiments, the additional suits in the new deck may be used as a basis for side wagers. In some examples, as described above, a property of the themed suits and a relationship defined by the suits may serve as a basis for side wagers. Additionally, any combination of suits and ranks of the new deck may serve as a basis for side wagers. In one example, where the new deck face cards are represented by the gods Fuk, Luk, Sau (or other gods), god-based side wagers may be provided.

For example, with respect to a game of baccarat a series of side wagers may be provided using the new deck of cards.

For example, "Gods" side wagers are provided where players can bet separately on the first two cards or all cards of the banker hand or the player hand. The gods side wager may be a wager facilitated by the use of the god symbols as face cards, where the player can wager on pairs of gods, Fuk, Luk or Sau appearing as the first two cards or all cards of the banker hand or the player hand.

The "elements" side wager is a single wager where the player can wager on the combined banker and player cards resulting in four or more suits and a total number of cards being greater than four. "Cards" side wagers are three separate wagers that allow the player to bet on the total number of cards drawn to complete the round.

The "sequence" wager is another side wager where the player can wager on all cards drawn in a hand forming a straight with the highest straight for this bet being the Fuk-Luk-Sau (King-Queen-Jack). The more cards dealt to form the straight, the higher the player return.

The "tiered banker six" wager in conjunction with no-commission baccarat is a wager paid (e.g., a 1 to 2 payoff) if the winning banker hand is a total of 6, but pays a higher premium if the hand is a three cards banker win of 6.

The "Fuk-Luk-Sau progressive" wager allows the player to wager on a sequence of Fuk-Luk-Sau being dealt. In some examples, the sequence can be broken by other cards. In some examples, the three cards must be ordered as Fuk drawn before Luk, and Luk drawn before Sau. In one example, the progressive is won if both the Player and Banker hands each have drawn Fuk-Luk-Sau.

The above bases for such side wagers are provided herein for example purposes. It should be understood by a person skilled in the art that other side wagers or additional wagers may also be available using the new deck of cards and that the examples provided herein do not limit the side wagers provided by the new deck. It should be further understood that, in some examples, the bases for side wagers in the game of baccarat may be modified in accordance with card game rules known in the art.

Additionally, while the additional features provided by the new deck of cards are described herein with respect to the game of baccarat for example purposes, the new deck may also be used in other card games known in the art. Similar side wagers or additional wagers may also be possible in such other games based on the concepts discussed herein, though, when necessary, the rules of the side wagers may be modified in accordance with rules of the particular card game for which the new deck may be used when necessary.

In some examples, games played using the new deck (e.g., selected cards from the new deck, or single or multiple sets of the new deck) as described herein, including for example, the game of baccarat and/or one or more other card games, may also be implemented in a virtual environment and/or via a computing application implemented using a variety of computing devices. Such computing devices may include any computer, kiosk, mobile device, game console, or casino machine capable of facilitating card games.

Figure 6:
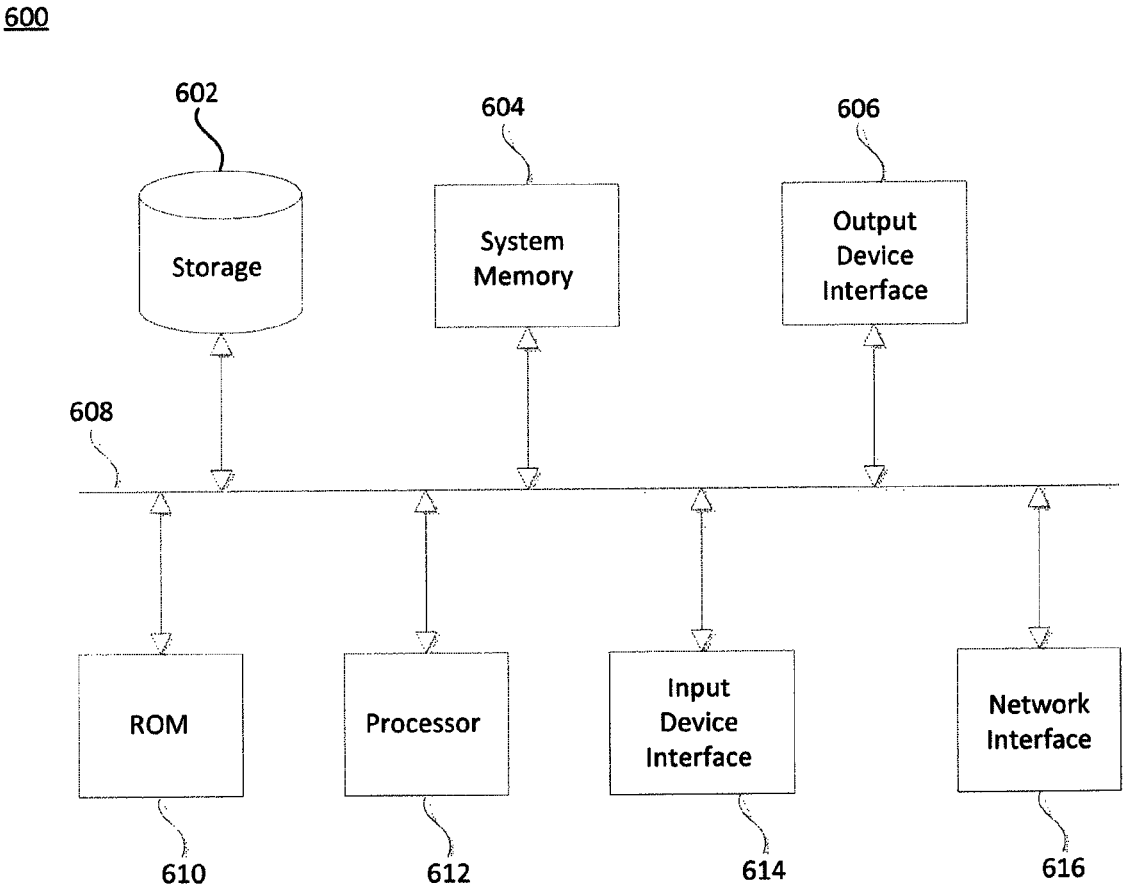
FIG. 6 conceptually illustrates an electronic system with which some implementations of the subject technology are implemented.

FIG. 6 conceptually illustrates an electronic system with which some implementations of the subject technology may be implemented. Electronic system 600 can be a server, computer, phone, PDA, laptop, tablet computer, television, kiosk, game console or casino machine with one or more processors embedded therein or coupled thereto, or any other sort of electronic device. Such an electronic system includes various types of computer readable media and interfaces for various other types of computer readable media. Electronic system 600 includes a bus 608, processing unit(s) 612, a system memory 604, a read-only memory (ROM) 610, a permanent storage device 602, an input device interface 614, an output device interface 606, and a network interface 616.

Bus 608 collectively represents all system, peripheral, and chipset buses that communicatively connect the numerous internal devices of electronic system 600. For instance, bus 608 communicatively connects processing unit(s) 612 with ROM 610, system memory 604, and permanent storage device 602.

From these various memory units, processing unit(s) 612 retrieves instructions to execute and data to process in order to execute the processes of the subject disclosure. The processing unit(s) can be a single processor or a multi-core processor in different implementations.

ROM 610 stores static data and instructions that are needed by processing unit(s) 612 and other modules of the electronic system. Permanent storage device 602, on the other hand, is a read-and-write memory device. This device is a non-volatile memory unit that stores instructions and data even when electronic system 600 is off. Some implementations of the subject disclosure use a mass-storage device (such as a magnetic or optical disk and its corresponding disk drive) as permanent storage device 602.

Other implementations use a removable storage device (such as a floppy disk, flash drive, and its corresponding disk drive) as permanent storage device 602. Like permanent storage device 602, system memory 604 is a read-and-write memory device. However, unlike storage device 602, system memory 604 is a volatile read-and-write memory, such a random access memory. System memory 604 stores some of the instructions and data that the processor needs at runtime. In some implementations, the processes of the subject disclosure are stored in system memory 604, permanent storage device 602, and/or ROM 610. For example, the various memory units include instructions for facilitating a card game, such as baccarat, using the new deck, according to various implementations. From these various memory units, processing unit(s) 612 retrieves instructions to execute and data to process in order to execute the processes of some implementations.

Bus 608 also connects to input and output device interfaces 614 and 606. Input device interface 614 enables the user to communicate information and select commands to the electronic system. Input devices used with input device interface 614 include, for example, alphanumeric keyboards and pointing devices (also called "cursor control devices"). Output device interfaces 606 enables, for example, the display of images generated by the electronic system 600. Output devices used with output device interface 606 include, for example, printers and display devices, such as cathode ray tubes (CRT) or liquid crystal displays (LCD). Some implementations include devices such as a touchscreen that functions as both input and output devices.

Finally, as shown in FIG. 6, bus 608 also couples electronic system 600 to a network (not shown) through a network interface 616. In this manner, the computer can be a part of a network of computers (such as a local area network ("LAN"), a wide area network ("WAN"), or an Intranet, or a network of networks, such as the Internet. Any or all components of electronic system 600 can be used in conjunction with the subject disclosure.

These functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "server", "processor", and "memory" all refer to electronic or other technological devices. These terms exclude people or groups of people. For the purposes of the specification, the terms display or displaying means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Implementations of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some implementations, a server transmits data (e.g., an HTML page) to a client device (e.g., for purposes of displaying data to and receiving user input from a user interacting with the client device). Data generated at the client device (e.g., a result of the user interaction) can be received from the client device at the server.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

What is claimed is:

1. A system for facilitating a card game using a modified deck of cards, the system comprising:

one or more processors;

one or more input devices that receives wagers in the form of a physical item representing monetary value;

a display screen operably connected to the one or more input devices and the one or more processors; and a machine-readable medium comprising instructions stored therein, which when executed by the processors, cause the processors to perform operations comprising:

providing for selection a plurality of predetermined game outcomes based on a deck of cards comprising five groups of cards, each group haying a unique themed suit and each card represented by one of the unique themed suits, each themed suit representative of a respective physical element from a group of physical elements comprising wood, fire, earth, metal, and water, wherein each of the physical elements represented by the unique themed suits is in a predetermined relationship with at least one other physical element in the group of physical elements;

receiving, from the one or more input devices, one or more wagers selectable from a plurality of wagers from a player on a selected one of the predetermined game outcomes comprising a drawing of cards having respective physical elements in a selected one of the predetermined relationships of the physical elements;

dealing, at the display screen, the cards of the deck of cards, the dealing comprising a drawing of a first and a second card from the deck of cards;

determining that a first and a second physical element of the first and second cards are in one of the predetermined relationships of the physical elements; and providing, at the display screen, a return based on the determining and the received one or more wagers.

2. The system of claim 1, wherein the rank of each of the face cards comprise the Chinese gods Fuk, Luk and Sau, and, wherein the value of ranking of the face cards is provided in order of Fuk then Luk then Sau.

3. The system of claim 2, wherein at least one wager of the one or more wagers comprises a wager according to the face cards dealt within the game of cards.

4. The system of claim 3, wherein the game of cards comprises baccarat and wherein the one or more wagers includes one or more side wagers in addition to the standard base wagers and side wagers provided in the traditional game of baccarat.

5. The system of claim 4, wherein the one or more side wagers include one or more of a gods wager in which a player bets on pairs of gods of same or different suit being dealt, a sequence wager in which a player bets on all three gods of the same or different suit being dealt or a Fuk-Luk-Sau progressive wager in which a player bets on the three gods appealing the ranking order of Fuk, Luk and Sau.

6. The system of claim 1, wherein the system comprises a casino game console.

7. The system of claim 1, wherein the one or more wagers comprise a second wager on a game outcome comprising a third card being drawn that represents a third physical element, and the first and third, or second and third, physical elements being in a second predetermined combination of physical elements.

8. The system of claim 1, wherein each element corresponds to a themed suit.

* * * * *